US006655122B2

(12) United States Patent
Shigeyama et al.

(10) Patent No.: US 6,655,122 B2
(45) Date of Patent: Dec. 2, 2003

(54) CORE YARN MANUFACTURING MACHINE AND CORE YARN MANUFACTURING METHOD

(75) Inventors: Masazumi Shigeyama, Shiga (JP); Harutoshi Sawada, Kyoto (JP)

(73) Assignee: Murata Kikai Kabushiki Kaisha, Kyoto (JP)

( * ) Notice: Subject to any disclaimer, the term of this patent is extended or adjusted under 35 U.S.C. 154(b) by 180 days.

(21) Appl. No.: 09/935,751

(22) Filed: Aug. 24, 2001

(65) Prior Publication Data

US 2002/0026781 A1 Mar. 7, 2002

(30) Foreign Application Priority Data

Sep. 1, 2000 (JP) ..... 2000-269879

(51) Int. Cl.[7] ..... D02G 3/36; D01H 1/115; D01H 4/30

(52) U.S. Cl. ..... 57/5; 57/264; 57/315; 57/328; 57/333; 57/350; 57/403

(58) Field of Search ..... 57/3, 4, 5, 6, 17, 57/264, 315, 328, 333, 350, 400, 403

(56) References Cited

U.S. PATENT DOCUMENTS 5,673,547 A * 10/1997 Baba et al. ..... 57/261
6,370,858 B1 * 4/2002 Mori ..... 57/6
2002/0124543 A1 * 9/2002 Bischofberger et al. ..... 57/5

FOREIGN PATENT DOCUMENTS

| | | | | |
|---|---|---|---|---|
| EP | 1184495 A2 * | 3/2002 | ..... | D02G/3/36 |
| JP | 47-10260 | 3/1972 | | |
| JP | 03152219 A * | 6/1991 | ..... | D01H/1/115 |
| JP | 04352820 A * | 12/1992 | ..... | D01H/1/115 |
| JP | 2713089 | 10/1997 | | |
| JP | 2001073235 A * | 3/2001 | ..... | D01H/4/02 |
| JP | 2002069761 A * | 3/2002 | ..... | D01H/1/115 |

* cited by examiner

*Primary Examiner*—John J. Calvert
*Assistant Examiner*—Shaun R Hurley
(74) *Attorney, Agent, or Firm*—Armstrong, Westerman & Hattori, LLP.

(57) ABSTRACT

A core yarn manufacturing machine has a spinning unit including a hollow guide shaft member wherein the yarn passage is formed in the axis direction, and a nozzle applies a whirling flow to the tip section of the hollow guide shaft member. A core yarn is manufactured by winding the fiber bundle into the spinning unit, around the core fiber which is also fed, in the tip section of the hollow guide shaft member. The machine has a suction force producer for producing a suction force toward the interior of the yarn passage from the entrance of the hollow guide shaft member, and a core fiber feeding apparatus that feeds to the spinning unit. A control device controls the operation and non-operation of the whirling flow generating nozzle, the suction force producer and the core fiber feeding apparatus.

5 Claims, 6 Drawing Sheets

CORE YARN MANUFACTURING MACHINE AND CORE YARN MANUFACTURING METHOD

FIELD OF THE INVENTION

The present invention relates to a core yarn manufacturing machine and a core yarn manufacturing method which manufacture the core yarn like a true twist by a hollow guide shaft member and the whirling flow which acts upon the tip section of the hollow guide shaft member, and especially to a core yarn manufacturing machine and a core yarn manufacturing method capable of carrying out automatic yarn pick-up.

BACKGROUND OF THE INVENTION

Core yarn manufactured by a hollow guide shaft member and a whirling flow which acts upon the tip section of the hollow guide shaft member, includes multifilament yarn of a synthetic fiber, such as polyester, as a core fiber, and has a fiber bundle of cotton or the like wound around the core fiber. The core fiber cannot be seen from the surface, and the core fiber is concentrated in the center.

The core yarn manufactured by using such whirling flow is especially characterized in that the thickness of the core fiber can be made more than 50% and the torque (the level of the yarn shrinking in the axis direction) is small, compared to core yarn manufactured by a ring spinning frame.

The core yarn manufactured by the ring spinning frame is formed to be a core yarn like a true twist by being twisted while whirling the yarn around the winding bobbin. However, the core fiber can be seen from the surface and the core fiber exists also in the areas around the center.

Therefore, there is the core yarn manufacturing machine for manufacturing core yarn like a true twist, comprising air-typed spinning unit which is fed with core fiber and the drafted fiber bundle.

The spinning unit is comprised of a hollow guide shaft member wherein the yarn passage is formed in the axis direction, and a whirling flow generating nozzle which generates whirling flow to the tip section of the hollow guide shaft member.

The core yarn manufacturing machine manufactures core yarn by winding the fiber bundle guided into the spinning unit after being drafted, around the core fiber fed to the spinning unit along with the fiber bundle at the tip section of the hollow guide shaft member.

However, the core yarn manufacturing machine adopting the hollow guide shaft member and the whirling flow which acts upon the tip section of the hollow guide shaft member, were not considered to carry out automatic yarn pick-up of the core yarn, including the automatic feeding of the core fiber.

The core yarn manufacturing machine forms a core yarn like a true twist, by the fiber bundle being sucked into the yarn passage, and the reversing fiber separated from the fiber bundle, being wound around the core fiber. Therefore, when attempting the automatic yarn pick-up under the same condition as the normal spinning operation, the force to suck in the fiber bundle into the yarn passage of the hollow guide shaft member, is not produced only by the whirling flow of the whirling flow generating nozzle. Thus, the fiber bundle cannot be exhausted from the yarn outlet of the spinning unit as a yarn.

The object of the present invention is to provide a core yarn manufacturing machine and a core yarn manufacturing method capable of carrying out automatic yarn pick-up of the core yarn like a true twist.

SUMMARY OF THE INVENTION

The present invention was made in consideration to the object mentioned above. The present invention is a core yarn manufacturing machine comprising a spinning unit constituting a hollow guide shaft member wherein the yarn passage is formed in the axis direction, and a whirling flow generating nozzle for applying whirling flow to the tip section of the hollow guide shaft member; wherein a core yarn is manufactured by winding the fiber bundle drafted and guided into the spinning unit, around the core fiber fed to the spinning unit, along with the fiber bundle in the tip section of the hollow guide shaft member; wherein the core yarn manufacturing machine comprises a suction force producing means for producing the suction force toward the interior of the yarn passage from the entrance of the hollow guide shaft member, a core fiber feeding apparatus for feeding the core fiber to the spinning unit, and a control device for controlling the operation and non-operation of the whirling flow generating nozzle, the operation and non-operation of a suction force producing means, and the operation and non-operation of the core fiber feeding apparatus.

According to the composition described above, a strong suction force is generated toward the interior of the yarn passage from the yarn entrance of the yarn passage, allowing the core fiber and the fiber bundle to be taken in to the yarn entrance. As a result, automatic yarn pick-up of the core yarn from the yarn outlet can be carried out by passing through the yarn passage.

The present invention is the core yarn manufacturing machine wherein the suction force producing means is a compressed air injecting nozzle which injects compressed air into the yarn passage of the hollow guide shaft member. According to this composition, a strong suction force can be produced to the entrance of the hollow guide shaft member, with simple composition.

The present invention is a core yarn manufacturing machine wherein the suction force producing means is a compressed air injecting nozzle which injects compressed air into the yarn passage of the hollow guide shaft member. According to this composition, a strong suction force can be produced to the entrance of the hollow guide shaft member.

The present invention is the core yarn manufacturing machine wherein the injection pressure of the whirling flow generating nozzle can be switched between high and low according to the signal from the control device. As a result, the success rate of the yarn pick-up is improved by minimizing the whirling force of the core fiber and the fiber bundle which are moved by the whirling flow of the whirling flow generating nozzle, in proximity to the entrance of the hollow guide shaft member.

According to the composition described above, the core fiber and the fiber bundle can be sucked in by generating strong suction force toward the interior of the yarn passage from the yarn entrance of the yarn passage. As a result, automatic yarn pick-up of the core yarn from the yarn outlet can be carried out by passing through the yarn passage.

The present invention is the core yarn manufacturing method wherein the whirling flow generating nozzle carries out low pressure injection first when carrying out yarn pick-up of the core yarn, and can switch to high pressure injection after the core yarn passes through the yarn passage of the hollow guide shaft member and is exhausted from the yarn outlet of the spinning unit.

According to the composition described above, the whirling force which moves the core fiber and the fiber bundle in proximity to the entrance of the hollow guide shaft member, is minimized and the suction force of the suction force producing means acts more efficiently. Therefore, the success rate of the yarn feeding of the core fiber and the fiber bundle to the yarn passage improves, and the success rate of the yarn pick-up from the yarn passage also improves.

DETAILED DESCRIPTION OF THE PREFERRED EMBODIMENTS

The preferred embodiment of the present invention will now be described in reference to the accompanying drawings. In the following description, the core fiber is a yarn which is to be the core, and includes the spun yarn formed by the staples (short fibers) being twisted, not only the monofilament or the multifilament yarn comprised of synthetic fiber; the core yarn includes the yarn which is to be the core as mentioned above, in the center, and is formed by winding the staples as a sheath around the yarn; and the fiber bundle is formed by collecting the staples.

First, the entire composition will be described by referring to FIG. 6.

Figure 6:
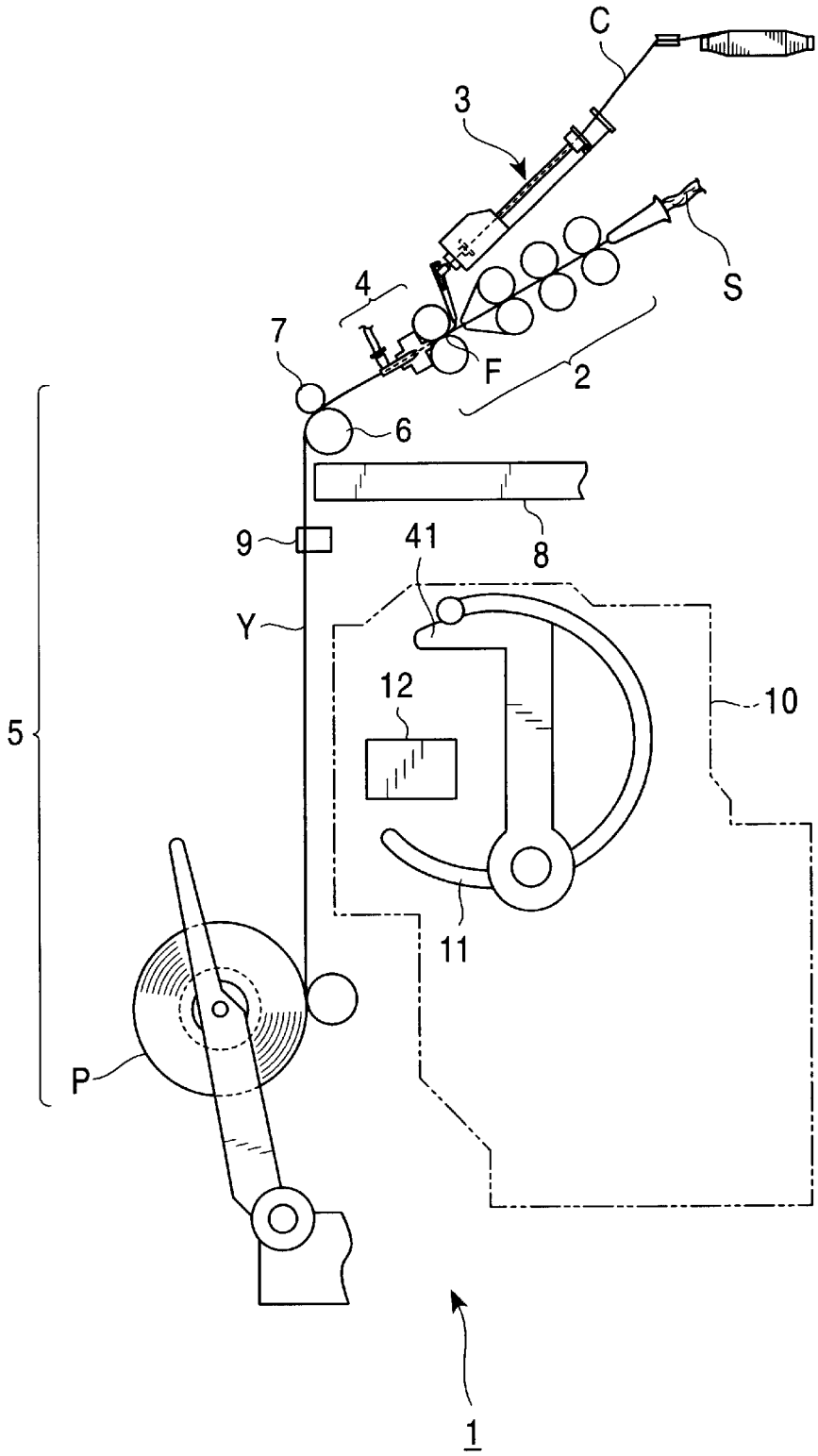
FIG. 6 is a schematic diagram showing the entire composition of the present invention.

FIG. 6 is a schematic diagram showing the entire composition of the core yarn manufacturing machine of the present invention.

As shown in FIG. 6, a core yarn manufacturing machine 1 is comprised of a drafting apparatus 2 which drafts a sliver S into a designated thickness, a core fiber feeding apparatus 3 for feeding a core fiber C, a spinning unit 4 which is to be fed with the core fiber C and a drafted fiber bundle F, and a winding unit 5 which winds the core yarn Y like a true twist exhausted from the spinning unit 4, to form a package P. These are made as one manufacturing unit. The core yarn manufacturing machine 1 is constituted by providing a plurality of manufacturing units in proximity in a row arrangement.

For example, the core yarn Y like a true twist includes the multifilament yarn which is a synthetic fiber of polyester or the like, as a core fiber, and has a fiber bundle of cotton or the like as the covering fiber wound around the core fiber.

The winding unit 5 is comprised of, for example, a delivery roller 6 and a nip roller 7 for delivering the core yarn Y which is exhausted from the spinning unit 4 of the upstream side to the downstream side, a slack tube (yarn accumulating member) 8 for securing the yarn by sucking the core yarn Y when joining the yarn, and a yarn clearer 9 for cutting the core yarn Y when the core yarn Y of the desired thickness does not pass through after the thickness of the core yarn Y is detected.

One or a plurality of yarn joining apparatus 10 is employed capable of running along the longitudinal direction of the core yarn manufacturing machine 1. In other words, the yarn joining apparatus 10 runs along the arrangement of the manufacturing units. The yarn joining apparatus 10 comprises an upper suction pipe 11 capable of moving in the vertical direction, a yarn joining unit 12, and a lower suction pipe 41 capable of moving in the vertical direction.

When yarn breakage occurs in some manufacturing units, the yarn joining apparatus 10 stops after running to the backside of the designated unit. Then, the tip of the upper suction pipe 11 which is the yarn sucking and catching apparatus of the spinning side, moves to the yarn outlet of the spinning unit 4 and sucks in the core yarn Y which is to be exhausted from the spinning unit 4.

Next, the upper suction pipe 11 is moved to guide in the core yarn Y into the yarn joining unit 12, and then the core yarn Y drawn from the package P by a lower suction pipe 41 which is the yarn sucking and catching apparatus of the winding side, and the core yarn Y drawn by the upper suction pipe 11 is joined in the yarn joining unit 12.

Figure 1:
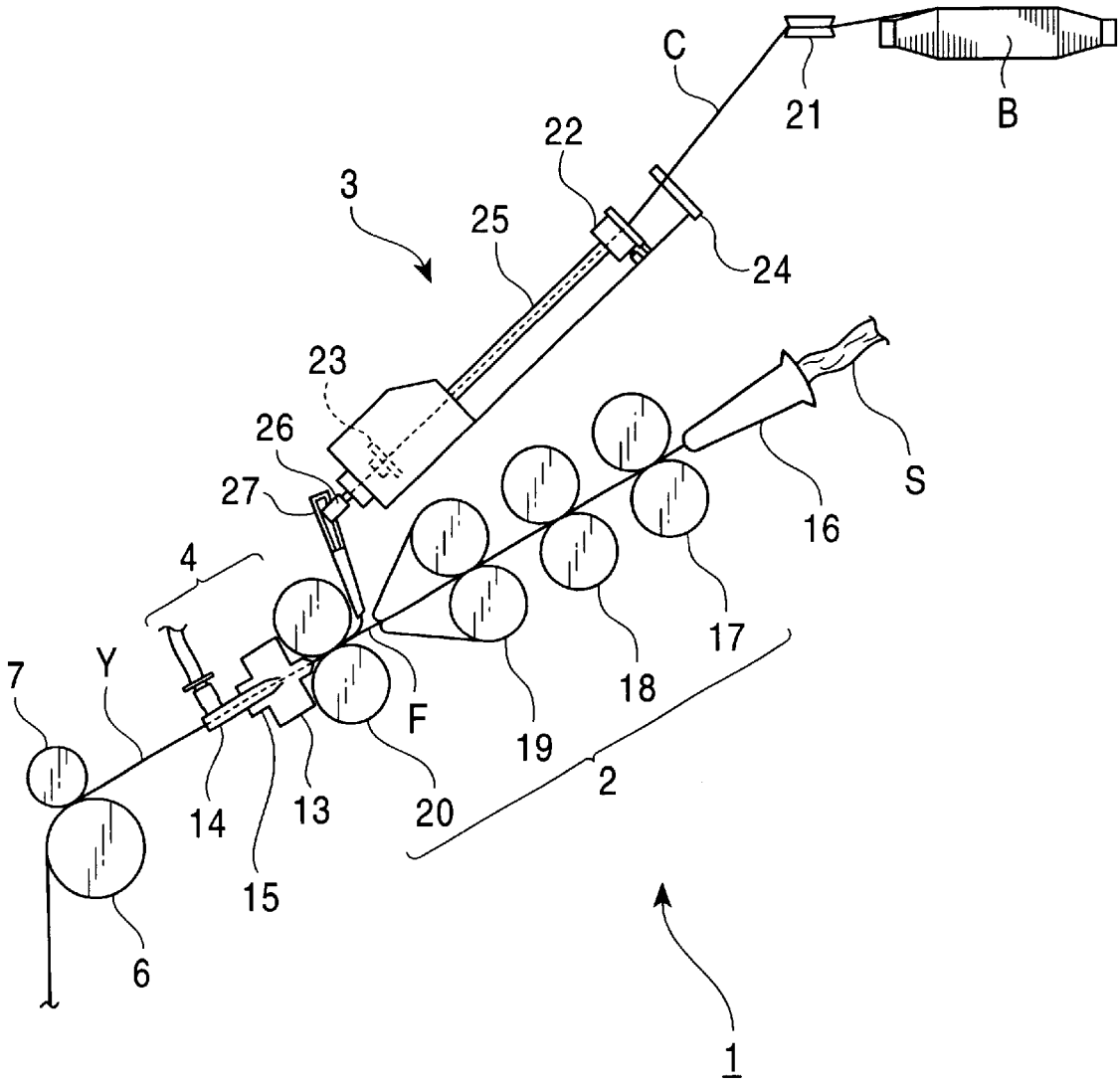
FIG. 1 is a schematic diagram showing the preferred embodiment of the present invention.

FIG. 1 is a schematic diagram showing the main part of the core yarn manufacturing machine which is the preferred embodiment of the present invention.

As shown in FIG. 1, the main part of the core yarn manufacturing machine 1 comprises a drafting apparatus 2, a core fiber feeding apparatus 3, and a spinning unit 4.

The core yarn manufacturing machine 1 of the present invention comprises the spinning unit 4 which includes a hollow guide shaft member 14 wherein the yarn passage is formed in the axis direction, and a whirling flow generating nozzle 13 which produces whirling flow to the tip section of the hollow guide shaft member 14. A fiber bundle F which has been drafted and guided into the spinning unit 4 is wound around the core fiber C which has been fed to the spinning unit 4 along with the fiber bundle F in the tip section of the hollow guide shaft member 14, for the manufacturing of the core yarn. The core yarn manufacturing machine 1 comprises a suction force producing means 15 for producing suction force toward the interior of the yarn passage from the entrance of the hollow guide shaft member 14, a core fiber feeding apparatus 3 for feeding the core fiber C to the spinning unit 4, and a control device 70 for controlling the operation and non-operation of the whirling flow generating nozzle 13, the suction force producing means 15 and the core fiber feeding apparatus 3.

The core yarn manufacturing machine 1 of the present invention is capable of manufacturing a core yarn like a true twist, especially strong against squeezing, by the core fiber C composed of multifilament or the like, being loosened a little by the whirling flow of the whirling flow generating nozzle 13, and the fiber of the fiber bundle F being wound around the core fiber C while being caught into the gap of the core fiber C (between the filaments composing the core fiber).

The drafting apparatus 2 drafts a sliver S fed via a trumpet 16, to form the fiber bundle F of the designated thickness, via a plurality of draft rollers. A pair of back rollers 17, a pair of third rollers 18, a pair of second rollers 19 with apron belt hung, and a pair of front rollers 20 are the draft rollers, arranged in this order, starting from the upstream side.

The core fiber feeding apparatus 3 is employed diagonally above the drafting apparatus 2. For example, the core fiber feeding apparatus 3 comprises a tensor 21 which applies a prescribed tension to the core fiber C which has been unwound from a bobbin B of the upstream side, an air sucker 22 which sucks in and delivers to the downstream side the core fiber C via the tensor 21, and a clamp cutter 23 which cuts and holds the core fiber C.

According to the embodiment of the present invention, a feeler 24 for detecting the presence or the absence of the core fiber C is employed between the tensor 21 and the air sucker 22. The feeler 24 transmits a signal to the control device 70 in the case the core fiber C is cut by some reason, and the control device 70 which has received the signal, stops the operation of the core yarn manufacturing machine 1.

The core fiber feeding apparatus 3 feeds the core fiber C to the spinning unit 4. In the core fiber feeding apparatus 3, the core fiber C passes from the upstream side, from the tensor 21, the feeler 24, the air sucker 22, a yarn guiding tube 25, the clamp cutter 23, a tip yarn guiding tube 26 and a funnel-shaped guide 27, in this order.

In the embodiment of the present invention, for example, the funnel-shaped guide 27 is employed in the upstream side of the front roller 20. Thus, the core fiber C is arranged to be fed to the spinning unit 4 from the upstream side of the front roller 20, along with the fiber bundle F.

Next, the spinning unit 4 will be described.

Figure 2:
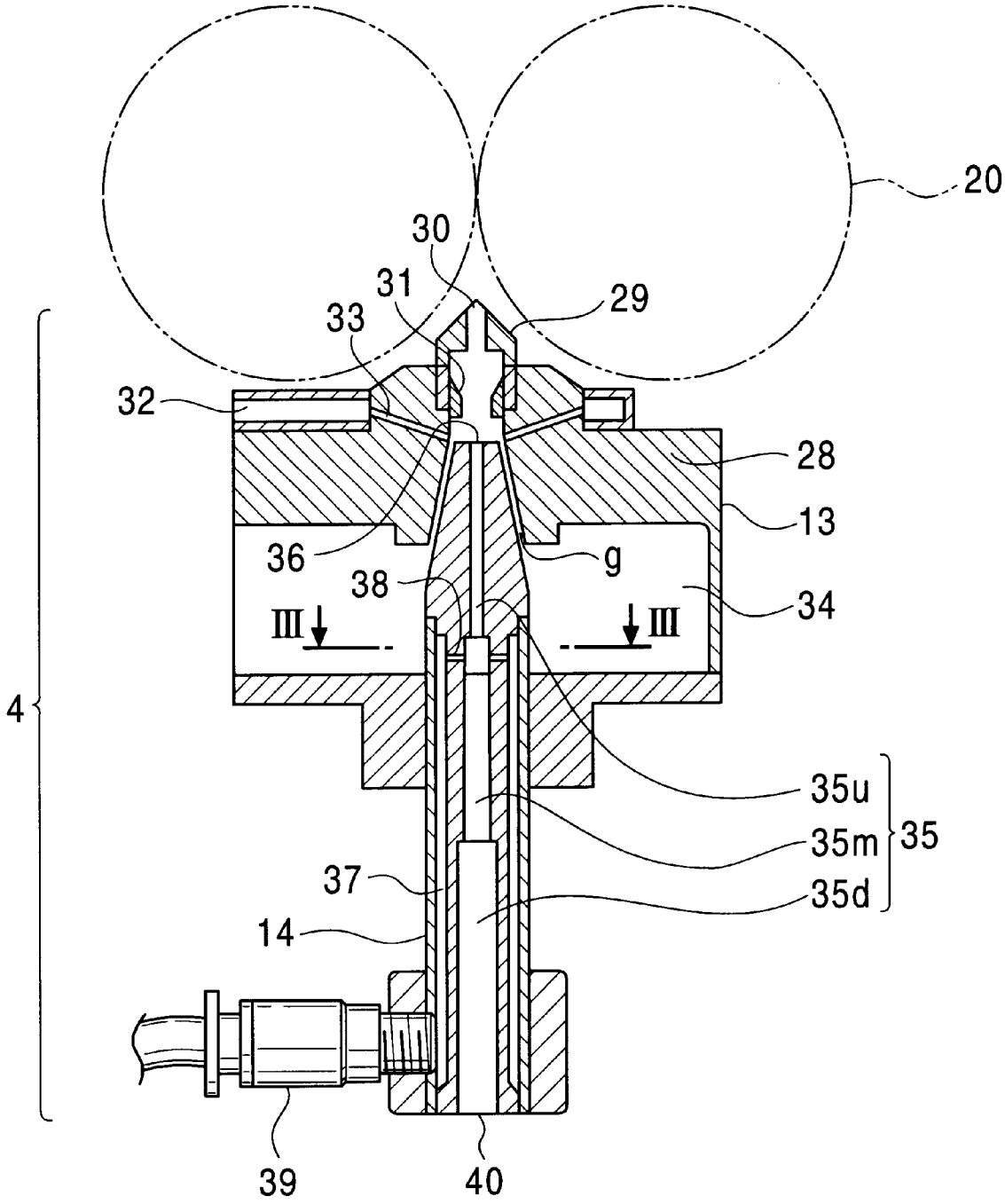
FIG. 2 is a sectional view of the spinning unit according to the present invention.

FIG. 2 is a sectional view showing the spinning unit 4 according to the present invention.

As shown in FIG. 2, the spinning unit 4 is disposed with the whirling flow generating nozzle (spinning nozzle) 13, and the hollow guide shaft member 14 of which the tip section is to be inserted into the whirling flow generating nozzle 13. The tip (the inlet of the fiber bundle) of the whirling flow generating nozzle 13 is employed in proximity to the downstream side outlet of the front roller 20.

The whirling flow generating nozzle 13 is comprised of a nozzle main body 28 of which the whole body is formed in a nearly cylindrical shape. An inlet cap 29 is attached to the tip section of the whirling flow generating nozzle 13, projecting little. A passage way 30 which receives the core fiber C and the fiber bundle F, fed from the front roller 20, is formed in the axis direction of the inlet cap 29. A bush 31 which decreases the spreading of the core fiber C and the fiber bundle F, is employed in proximity to the outlet of the passage way 30.

A ringed flow channel 32 for blowing air in the periphery direction, and a plurality of nozzle openings 33 for guiding air to the radial direction from the ringed flow channel 32 and for injecting air to the downstream side of the bush 31, are formed in the upstream side of the nozzle main body 28. Each nozzle opening 33 is formed inside the nozzle main body 28, inclining from the upstream side to the downstream side. On the other hand, a space area 34 for blowing out the air injected from the nozzle opening 33 to the outside is formed in the downstream side of the nozzle main body 28.

The air supplying apparatus is connected to the ringed flow channel 32, and the whirling flow generating nozzle 13 is made to generate the whirling flow in proximity to the tip section of the hollow guide shaft member 14 so that the injection pressure can be switched between high and low.

The hollow guide shaft member 14 is formed in almost a pole form so that the tip section is to be a little thin, and the yarn passage 35 of which the cross section is in almost a circular form, is formed to pass through in the axis direction. A yarn passage 35 is comprised of an upstream side yarn passage 35*u*, a midstream side yarn passage 35*m*, and a downstream side yarn passage 35*d*.

The cross sectional area is made to be enlarged gradually from the upstream side to the downstream side.

The tip section of the hollow guide shaft member 14 forms a little gap (g) between the nozzle main body 28. In addition, the hollow guide shaft member 14 is inserted into the whirling flow generating nozzle 13 so that a yarn entrance 36 of the yarn passage 35 is to be near the downstream side of the outlet of the nozzle opening 33.

The present invention was made to employ the suction force producing means 15 for producing the suction force toward the inside from the entrance of the tip section of the yarn passage 35 of the hollow guide shaft member 14, for carrying out yarn pick-up automatically of the core fiber C and the fiber bundle F from the outlet of the hollow guide shaft member 14. For example, a compressed air injecting nozzle 38 (nozzle for yarn pick-up) for injecting compressed air into the yarn passage 35 can be adopted for the suction force producing means 15. By generating suction flow in the yarn passage 35 inside the hollow guide shaft member 14 by the compressed air injecting nozzle 38, the core fiber C and the fiber bundle F can be sucked into the yarn passage 35, and the yarn pick-up from a yarn outlet 40 of the yarn passage 35 can be carried out by passing the core yarn which has the strength capable of being drawn out by the upper suction pipe 11, through the yarn passage 35.

A nozzle which produces inside the yarn passage 35, the whirling flow of which the direction is the opposite to the direction of the whirling flow generated by the spinning nozzle 13, can be adopted for the compressed air injecting nozzle 38. In this case, yarn pick-up can be carried out according to the fasciated spun yarn theory by the whirling flows in the clockwise direction and the counterclockwise direction. However, the nozzle is not necessarily required to produce the whirling flow.

In the present invention, the operation of the whirling flow generating nozzle 13, the generation of the suction force toward the interior of the yarn passage 35 from the yarn entrance 36 of the hollow guide shaft member 14, the feeding of the core fiber C to the spinning unit 4, and the feeding of the fiber bundle F to the spinning unit 4, are begun at an agreeable timing, and the yarn pick-up of the core yarn Y from the yarn outlet 40 of the spinning unit 4 is carried out by the control of the control device 70.

The whirling flow generating nozzle 13 can switch the injection pressure of the air injected from the nozzle opening 33, freely between high and low by the control of the control device 70. When carrying out yarn pick-up of the core yarn Y, the low pressure injection is continued until the prescribed period of time elapses after the beginning of the operation, and then it is switched to the high pressure injection. More specifically stating, when carrying out yarn pick-up of the core yarn Y, the whirling flow generating nozzle 13 which carries out the low pressure injection first, is made to switch to the high pressure injection after the feeding of the core fiber C and the fiber bundle F are begun, and after the core yarn Y which has passed the yarn passage 35 of the hollow guide shaft member 14 is discharged from the yarn outlet 40.

For example, a compressed air supplying apparatus 39 is connected to the back end of the hollow guide shaft member 14. A cylindrical shaped compressed air flow channel 37 for blowing the compressed air supplied from the compressed air supplying apparatus 39 is formed inside the hollow guide shaft member 14, along the downstream side yarn passage 35*d* and the midstream side yarn passage 35*m*. The inside diameter of the compressed air flow channel 37 is larger than the yarn passage 35, and the outside diameter thereof is smaller than the hollow guide shaft member 14.

The yarn passage 35 is formed so that the cross sectional area is to be enlarged gradually from the upstream side to the downstream side. As a result, the compressed air injected to the yarn passage 35 from the compressed air injecting nozzle 38, flows into the downstream side yarn passage 35*d* from the midstream side yarn passage 35*m* while generating whirling flow in the yarn passage 35, and flows out from the yarn outlet 40. On the other hand, the air injected from the nozzle opening 33 generates the whirling flow near the yarn entrance 36, flows through the gap (g) and flows outside from the space area 34 formed between the nozzle main body 28 and the supporting unit of the hollow guide shaft member 14.

In the present invention, strong suction force is generated toward the interior of the yarn passage 35 from the yarn entrance 36 of the yarn passage 35. As a result, the core fiber C and the fiber bundle F can be sucked into the yarn passage 35 from the yarn entrance 36, in synergy with the normal spinning movement by the whirling flow generating nozzle 13 and the hollow guide shaft member 14, by passing the core yarn like a true twist through the yarn passage 35, the automatic yarn pick-up from the yarn outlet 40 can be carried out in a form in which the core yarn like a true twist can be drawn out by an upper suction pipe 11.

Figure 3:
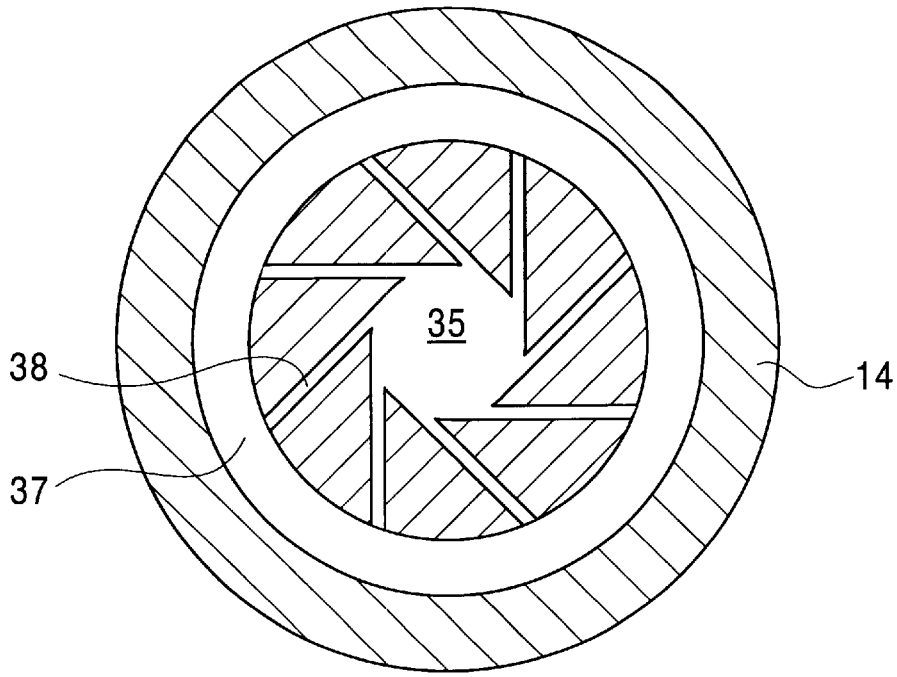
FIG. 3 is a III—III line sectional view of the spinning unit shown in FIG. 2.

FIG. 3 is a III—III line sectional diagram of the spinning unit 4 shown in FIG. 2.

As shown in FIG. 1, under the normal operation, the core fiber C is fed to the spinning unit 4 from the upstream side of the front roller 20 via the tensor 21, and is drew drawn out by the delivery roller 6 via the yarn passage 35.

Next, the relationship of the connection between the control device 70 and each unit will be described in reference to FIG. 7.

Figure 7:
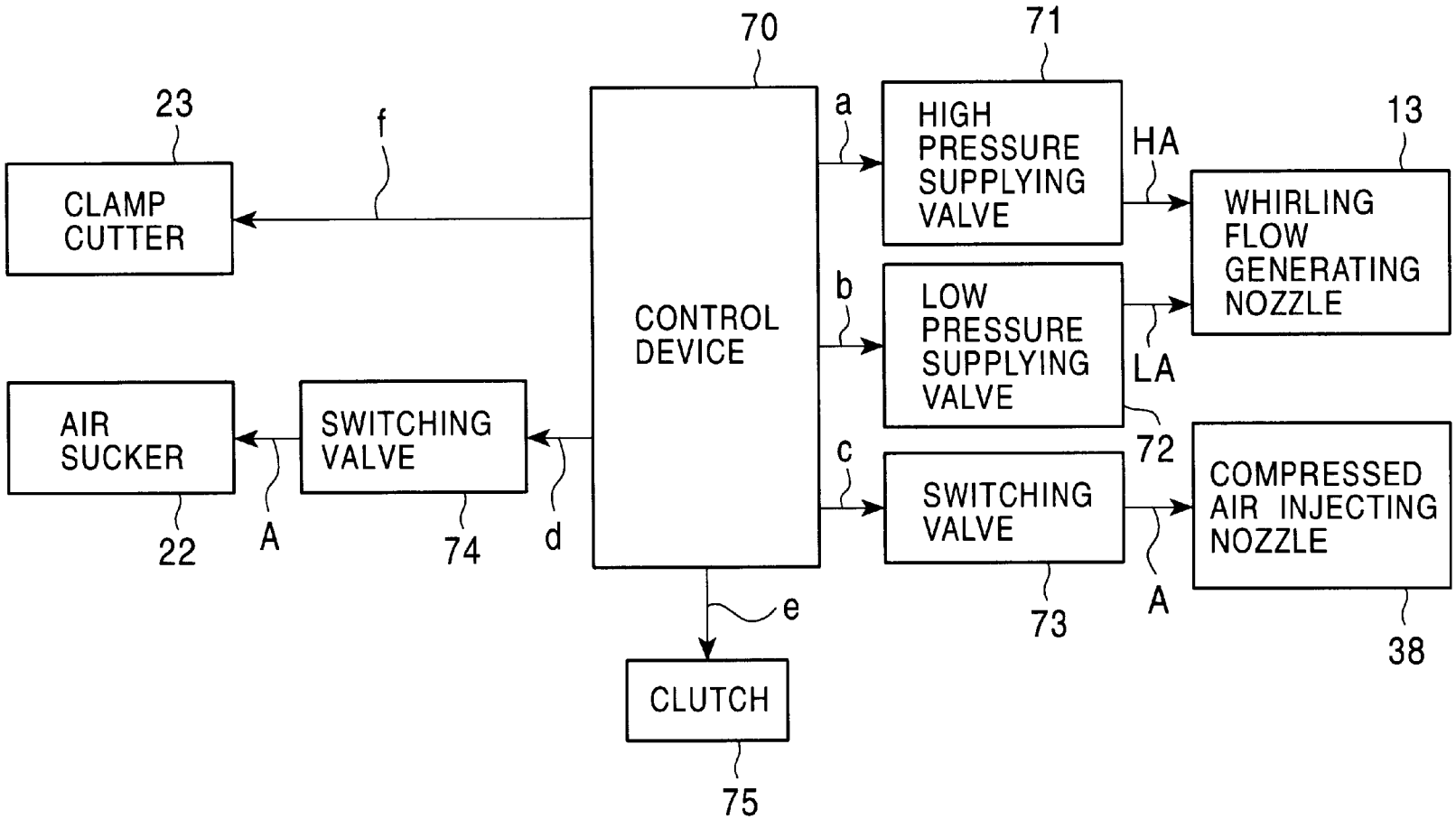
FIG. 7 is a block diagram showing the relationship of the connection between the control device and each unit according to the present invention.

FIG. 7 is a block diagram showing the relationship of the connection between the control device 70 and each unit according to the present invention.

As shown in FIG. 7, a high pressure supplying valve 71 and a low pressure supplying valve 72, which are capable of opening and closing independently from one another, are connected between the control device 70 and the whirling flow generating nozzle 13. The high pressure supplying valve 71 and the low pressure supplying valve 72 are connected to the compressed air source (not shown in the drawings) via a compressed air adjuster. The high pressure air HA or the low pressure air LA is supplied to the whirling flow generating nozzle 13 according to the high pressure supplying signal (a) or the low pressure supplying signal (b) from the control device 70. Thus, by switching the supplying signal from the control device 70, the injection pressure of the whirling flow generating nozzle 13 is made capable of freely switching between high pressure and low pressure.

A switching valve 73 is connected between the control device 70 and the compressed air injecting nozzle (nozzle for yarn pick-up) 38. When generating suction force in the yarn passage 35 of the hollow guide shaft member 14, the air A is supplied to the yarn pick-up nozzle 38 according to the suction force producing signal (c) from the control device 70.

The switching valve 74 is connected between the control device 70 and the air sucker 22 in the same manner. When feeding the core fiber C to the drafting apparatus 2 (the upstream side of the front roller 20), the feeding force is applied to the core fiber C by supplying the air A to the air sucker 22 according to the core fiber feeding signal (d) from the control device 70.

Moreover, the control device 70 is connected to a clutch 75 for switching the driving of the back roller 17 and the third roller 18. When feeding the fiber bundle F which has been stopped in the drafting apparatus 2 to the spinning unit 4, the clutch 75 is connected and the drafting roller (the back roller 17 and the third roller 18) which has been stopped, is re-driven, according to the fiber bundle feeding signal (e) from the control device 70.

The control device 70 is also connected to the clamp cutter 23, and when stopping the feeding of the core fiber C, the clamp cutter 23 is operated, and the core fiber C in the feeding process is cut and gripped according to the yarn cutting gripping signal (f) from the control device 70. When feeding the core fiber C again, as mentioned above, the gripping of the clamp cutter 23 is released by canceling the yarn cutting gripping signal (f) from the control device 70 while operating the air sucker 22.

Likewise, each of the signals (a) through (f) from the control device 70, controls each operation of the nozzle for yarn pick-up 38 as a suction force producing means 15, the air sucker 22 and the clamp cutter 23 (the core fiber feeding apparatus 3), the whirling flow generating nozzle 13, the back roller 17 and the third roller 18 (the drafting apparatus 2), or the like.

Next, the effect of the present invention will be described.

Figure 5:
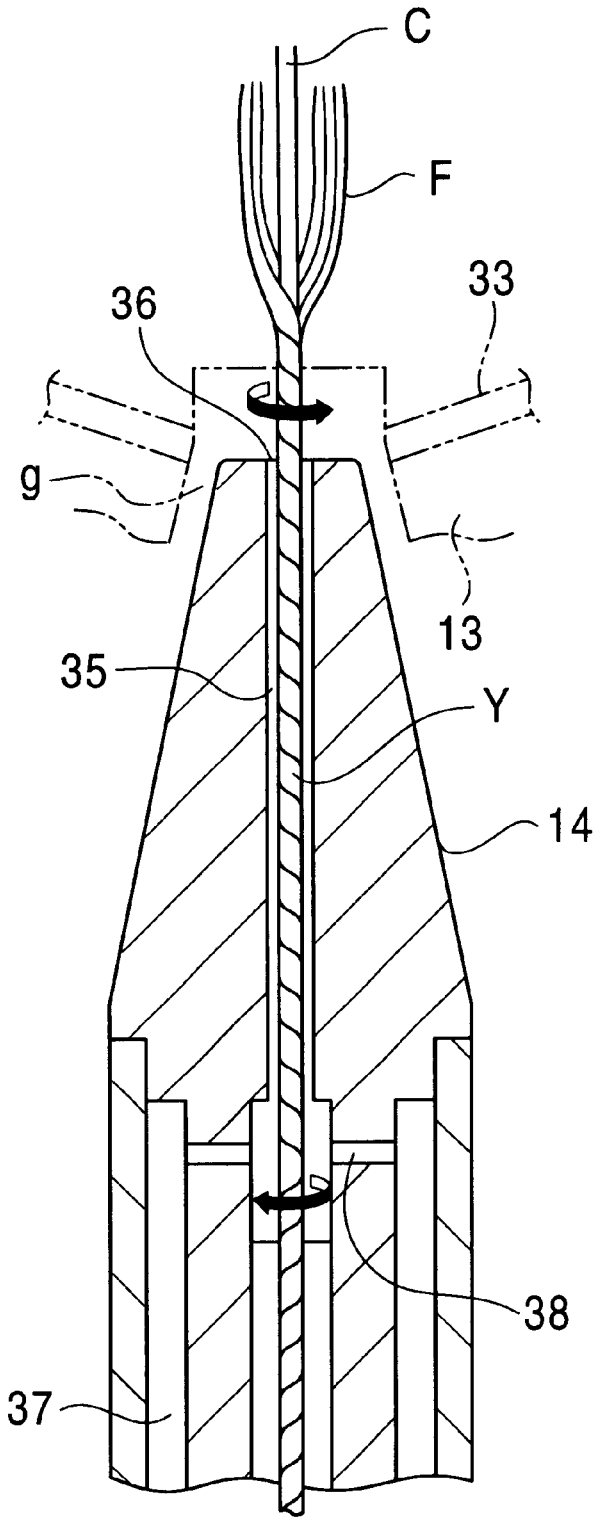
FIG. 5 is an expanded sectional view of the spinning unit shown in FIG. 2.

FIG. 5 is an expanded sectional view showing the spinning unit 4 illustrated in FIG. 2.

As shown in FIG. 1, under the normal operation, the core fiber C is fed to the spinning unit 4 from the upstream side of the front roller 20 via the tensor 21, and is drew out by the delivery roller 6 via the yarn passage 35.

On the other hand, the fiber bundle F which has been drafted in the drafting apparatus 2, is guided into the passage way 30 of the spinning unit 4 by the whirling flow (in the drawing, rightward direction) of the whirling flow generating nozzle 13 (refer to FIG. 2). As shown in FIG. 5, the tip of the fiber of the fiber bundle F is guided from the yarn entrance 36 of the hollow guide shaft member 14 into the yarn passage 35, by being pulled by the core fiber C. When the gripping by the front roller 20, located near the entrance of the spinning unit 4, is released, the end tip of the fiber of the fiber bundle F reverses from the yarn entrance 36 while the tip of the fiber of the fiber bundle F is sucked into the yarn passage 35, as to winding around the outer surface of the tip section of the hollow guide shaft member 14 by the component force of the axis direction of the whirling flow by the whirling flow generating nozzle 13. As a result, the core yarn Y like a true twist is formed by winding the end tip of the fiber of the fiber bundle F around the core fiber C, wherein the core fiber C is not appearing on the surface.

The core yarn Y like a true twist is exhausted from the yarn passage 35, and is formed into a package P by being wound at the winding unit 5 via the yarn picking-up unit comprised of a nip roller 7 and the delivery roller 6. Under such normal spinning operation, the compressed air is not injected from the compressed air injecting nozzle 38 as a suction force producing means 15.

In the case of yarn breakage, the feeding of the sliver S is stopped by the stopping of the back roller 17 and the third roller 18. At the same time, the clamp cutter 23 in the core fiber feeding apparatus 3 operates to cut the core fiber C, and grips the cut tip of the core fiber C. The yarn joining preparation completes with the arrival of the yarn joining apparatus 10 to each unit, and the spinning is resumed.

In the resuming of the spinning, the roller which has been stopped in the drafting apparatus 2, is re-driven and the fiber bundle F is fed to the spinning unit 4, with the suction opening of the upper suction pipe 11 of the yarn joining apparatus 10 placed in the proximity to the outlet of the spinning unit 4. Corresponding to the re-driving of the back roller 17 and the third roller 18, the feeding of the core fiber C from the upstream side of the front roller 20 into the drafting apparatus 2, is started. This is the same as the start of the spinning.

The core fiber C and the fiber bundle F fed to the spinning unit 4 via passing through the front roller 20 of the drafting apparatus 2, is formed into a core yarn Y like a true twist with the fiber of the fiber bundle F wound around the core fiber C, in the same manner as in the normal spinning operation.

In the present invention, the compressed air is injected from the compressed air injecting nozzle 38 as a suction force producing means 15 at the time being. The operation of the compressed air injection nozzle 38 is carried out at almost the same time as the operation of the whirling flow generating nozzle 13.

The yarn passage 35 is formed so that the cross sectional area is enlarged gradually from the upstream side to the downstream side. Therefore, the compressed air injected into the yarn passage 35 from the compressed air injecting nozzle 38, flows inside the yarn passage 35 toward the downstream side, and is discharged from the yarn outlet 40. On the other hand, the air injected from the nozzle opening 33, generates a whirling flow in proximity to the yarn entrance 36, and is discharged to the outside from the space area 34 after flowing through the gap (g).

In the present invention, at the beginning of the spinning (yarn pick-up), the core fiber C and the fiber bundle F can be sucked into the yarn entrance 36 by generating a strong suction force toward the interior of the yarn passage 35 from the yarn entrance 36 of the yarn passage 35, and the core yarn Y can be picked up automatically from the yarn outlet 40 by passing through the yarn passage 35.

As described above, when the nozzle which generates whirling flow of the direction opposite to the direction of the whirling flow by the spinning nozzle 13, is adopted for the compressed air injection nozzle 38, the core yarn Y like a fascinated spun yarn, is exhausted from the spinning unit 4 while the compressed air injecting nozzle 38 is operating. After the upper suction pipe 11 draws out the core yarn Y, and the feeding force by the delivery roller 6 is prepared, in other words, after the extruding force of the delivery roller 6 is applied to the core yarn Y passing through the interior of the spinning unit 4, the operation of the compressed air injecting nozzle 38 as a suction force producing means 15 is stopped and is switched to a normal spinning. When it is switched to the normal spinning wherein the influence of the compressed air injecting nozzle 38 is not applied, the core yarn Y like a true twist, not a fascinated spun yarn, is exhausted from the spinning unit 4. In the yarn joining operation of the yarn joining apparatus 10, all the core yarn Y like a fascinated spun yarn, sucked in by the upper suction pipe 11 is eliminated. As a result, a package P wherein only the core yarn Y like a true twist is wound, is formed by joining the yarn in the yarn joining unit 12, the core yarn Y like a true twist which is exhausted after the operation of the compressed air injecting nozzle 38 is stopped, and the core yarn Y like a true twist extruded from the winding package P side.

Figure 4:
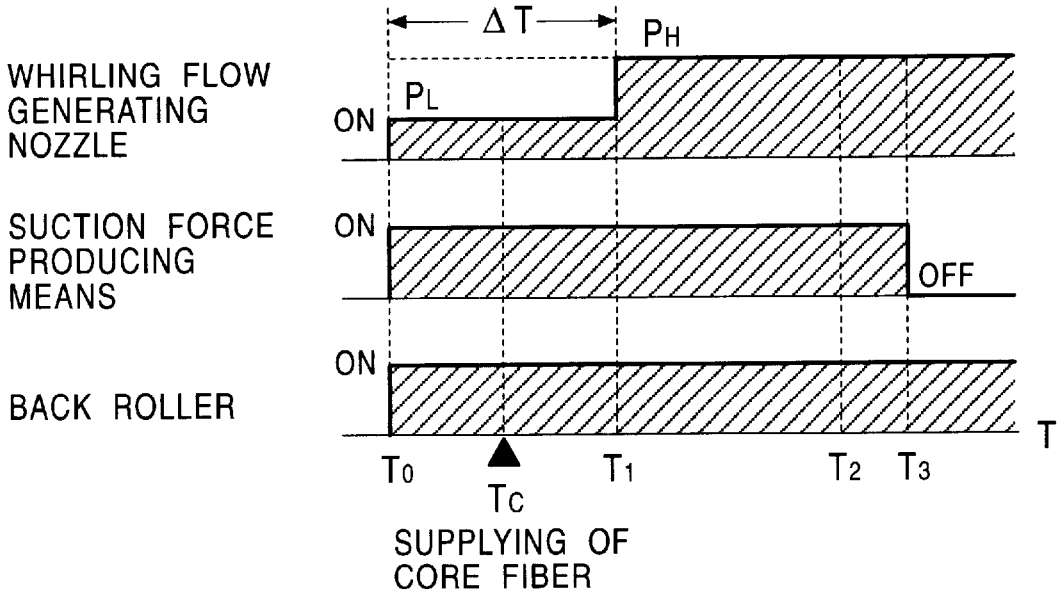
FIG. 4 is a diagram showing one of the examples of the control timing of the yarn pick-up according to the present invention.

FIG. 4 is a diagram showing one of the examples of the control timing of the yarn pick-up according to the present invention.

As shown in FIG. 4, at the spinning start time $T_o$, first, the whirling flow generating nozzle 13, the suction force producing means 15, the back roller 17 of the drafting apparatus 2 are put on (ON) at almost the same time. As a result, the fiber bundle F is guided to the yarn passage 35 of the hollow guide shaft member 14 by the suction force, while fed to the spinning unit 4 from the drafting apparatus 2.

At the time being, the injection pressure $P_L$ of the whirling flow generating nozzle 13 is made smaller than the spinning pressure $P_H$ of the normal spinning. The injection pressure P of the whirling flow generating nozzle 13 is switched to the spinning pressure $P_H$ of the normal spinning at time $T_1$, after the elapse of the prescribed period of time $\Delta T$ from the beginning of the feeding of the fiber bundle F.

The core fiber feeding apparatus 3 is began driving at the time Tc which is the time between $T_o$ and $T_1$ while the whirling flow generating nozzle 13 is being operated under the injection pressure $P_L$, and feeds the core fiber C from the upstream side of the front roller 20 so that the core fiber C overlaps with the fiber bundle F.

The back roller 17 can be put on (ON) between the time $T_o$ and $T_1$, and the core fiber C can be fed to the spinning unit 4 in advance of the fiber bundle F.

The suction force producing means 15 is put off (OFF) at the time $T_3$, the time after the time $T_2$, the time wherein a prescribed period of time elapsed after the time $T_1$ (when the core yarn Y to be exhausted from the spinning unit 4 is charged with the feeding force by the delivery roller 6).

Likewise, by making the pressure of the whirling flow generating nozzle 13 to be lower than the pressure at the normal spinning operation, at the start of the feeding of the core fiber C to the spinning unit 4, the whirling force for swinging the core fiber C in proximity to the entrance of the hollow guide shaft member 14, is minimized, and the suction force by the suction force producing means 15 is applied effectively. As a result, the core fiber C can be reliably fed to the yarn passage 35 of the hollow guide shaft member 14, the success rate of the feeding of the core fiber C to the yarn passage 35 is improved, and the success rate of the yarn pick-up from the yarn passage 35 can be also be improved. The drafted fiber bundle F is processed in the same manner.

Moreover, when feeding the core fiber C before the fiber bundle F, even if the whirling flow generating nozzle 13 is stopped (injection pressure P=0), there are cases in which the core fiber C can be delivered into the yarn passage 35 only by the suction force producing means 15.

The suction force producing means 15 according to the present invention can generate a strong suction force to the entrance of the hollow guide shaft member 14 just by a simple composition as described above.

According to the embodiment of the prsent invention, the core fiber C is located in the center of the fiber bundle F, and the twisting applied by the whirling flow can be prevented from spreading out to the front roller 20. As a result, the core yarn Y like a true twist wherein a plurality of fiber composing the fiber bundle F is to be the winding fiber, can be manufactured. Therefore, the embodiment was described with the example wherein the needle opposing to the entrance of the hollow guide shaft member 14 is not employed to the tip section of the whirling flow generating nozzle 13. In other words, since the core fiber C acts in the same manner as the needle (the effect for preventing the spreading into the upstream side, of the twisting applied to the fiber by the whirling flow, while guiding the fiber from the passage way 30 of the nozzle main body 28 into the yarn passage 35 of the hollow guide shaft member 14). Therefore, the core yarn Y like a true twist can be manufactured without the needle. However, the present invention is capable for adapting to both the presence and absence of the needle.

As it is evident from the description above, according to the present invention, the following excellent effects can be expected.

(1) The automatic yarn pick-up of thr core yarn like a true twist can be carried out by operating each movement at an appropriate timing according to the control from the control device.

(2) With the simple composition, strong suction force can be generated to the entrance of the hollow guide shaft member, if the suction force producing means is comprised of the compressed air injecting nozzle for injecting compressed air to the yarn passage of the hollow guide shaft member.

(3) By making the injection pressure of the whirling flow generating nozzle to be low pressure, right after the yarn pick-up spinning is started, the success rate of the yarn pick-up can be improved by minimizing the whirling force of the core fiber and the fiber bundle which are moved by the whirling flow of the whirling flow generating nozzle in proximity to the entrance of the hollow guide shaft member.

(4) The core fiber is loosened a little by the whirling flow of the whirling flow generating nozzle, and the fiber of the fiber bundle gets into the gap of the core fiber and is wound around the core fiber. As a result, a core yarn like true twist which is especially strong against squeezing, can be manufactured.

What is claimed is:

1. A core yarn manufacturing machine including a spinning unit formed by a hollow guide shaft member wherein the yarn passage is formed in the axis direction, and a whirling flow generating nozzle for applying whirling flow to the tip section of the hollow guide shaft member, wherein a core yarn is manufactured by winding the fiber bundle drafted and guided to the spinning unit, around the core fiber fed to the spinning unit along with the fiber bundle in the tip section of the hollow guide shaft member; comprising:

a suction force producing means for producing a suction force toward the interior of the yarn passage from an entrance of the hollow guide shaft member;

a core fiber feeding apparatus for feeding the core fiber to the spinning unit; and a control device for controlling the operation and non-operation of the whirling flow generating nozzle, the operation and non-operation of the suction force producing means, and the operation and non-operation of the core fiber feeding apparatus.

2. A core yarn manufacturing machine according to claim 1 wherein the suction force producing means is a compressed air injecting nozzle for injecting compressed air into the yarn passage of the hollow guide shaft member.

3. A core yarn manufacturing machine according to claim 1 or claim 2 wherein an injection pressure of the whirling flow generating nozzle can be switched between high and low according to the signal from the control device.

4. A core yarn manufacturing method comprising:

providing a spinning unit including a hollow guide shaft member having a yarn passage formed in the axis direction, and a whirling flow generating nozzle for applying whirling flow to the tip section of the hollow guide shaft member;

wherein the core yarn is manufactured by winding a fiber bundle drafted and guided to the spinning unit, around a core fiber fed to the spinning unit along with the fiber bundle, in the tip section of the hollow guide shaft member; and wherein the operation of the whirling flow generating nozzle, the generating of a suction force toward the interior of the yarn passage from the entrance of the hollow guide shaft member, the feeding of the core fiber to the spinning unit, and the feeding of the fiber bundle to the spinning unit, are started at an appropriate timing to carry out yarn pick-up of the core yarn from the yarn outlet of the spinning unit.

5. A core yarn manufacturing method according to claim 4 wherein the whirling flow generating nozzle carries out low pressure injection first when carrying out yarn pick-up of the core yarn, and is switched to high pressure injection after the core yarn is exhausted from the yarn outlet of the spinning unit via the yarn passage of the hollow guide shaft member.

* * * * *